US012012966B2

(12) United States Patent
Cui et al.

(10) Patent No.: US 12,012,966 B2
(45) Date of Patent: Jun. 18, 2024

(54) VANELESS CONTRA-ROTATING COMPRESSOR WITH MULTIPLE CONTRA-ROTATING INTERFACES

(71) Applicant: SHANDONG UNIVERSITY OF SCIENCE AND TECHNOLOGY, Qingdao (CN)

(72) Inventors: Weiwei Cui, Qingdao (CN); Kai Zhang, Qingdao (CN); Fei Yao, Qingdao (CN); Xinglu Wang, Qingdao (CN); Cuiping Wang, Qingdao (CN); Laishun Yang, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 18/065,359

(22) Filed: Dec. 13, 2022

(65) Prior Publication Data

US 2023/0287890 A1 Sep. 14, 2023

(30) Foreign Application Priority Data

Dec. 15, 2021 (CN) ..... 202111536523.4

(51) Int. Cl.
*F04D 19/02* (2006.01)
*F04D 29/32* (2006.01)

(52) U.S. Cl.
CPC ..... *F04D 19/024* (2013.01); *F04D 29/324* (2013.01)

(58) Field of Classification Search
CPC ..... F04D 25/28; F04D 19/024
See application file for complete search history.

(56) References Cited

U.S. PATENT DOCUMENTS 3,379,366 A * 4/1968 Garnier ..... F04D 27/0215 415/65
3,385,509 A * 5/1968 Garnier ..... F04D 19/024 415/914
3,391,540 A * 7/1968 Buager ..... F02K 3/06 415/60
3,524,318 A * 8/1970 Bouiller ..... F04D 19/024 415/60
4,159,624 A * 7/1979 Gruner ..... F02C 3/107 60/268

(Continued)

*Primary Examiner* — J. Todd Newton
*Assistant Examiner* — Cameron A Corday
(74) *Attorney, Agent, or Firm* — DLA PIPER LLP (US)

(57) ABSTRACT

A vaneless contra-rotating compressor with multiple contra-rotating interfaces and application of the vaneless contra-rotating compressor is provided, which includes at least two vaneless contra-rotating interfaces. For each of the at least two contra-rotating interfaces, the contra-rotating interface corresponds to two of vaneless contra-rotating rotors. A rotating direction of an upstream rotor of the two vaneless contra-rotating rotors and a rotating direction of a downstream rotor of the two vaneless contra-rotating rotors are opposite. Rectifier stator vanes are not provided among all the rotors to supply sufficient inlet negative pre-swirl for the downstream rotors through the upstream rotors. Only the outlet guide vanes of the last stage, of the vaneless contra-rotating rotors are provided. The number of stages and the number of vaneless contra-rotating interfaces may be set flexibly according to the actual pressurization requirements.

2 Claims, 4 Drawing Sheets

(56) References Cited

U.S. PATENT DOCUMENTS

| | | | | |
|---|---|---|---|---|
| 5,010,729 | A * | 4/1991 | Adamson | F02K 3/072 416/129 |
| 7,950,220 | B2 * | 5/2011 | Merry | F02C 3/067 60/774 |
| 7,966,806 | B2 * | 6/2011 | Henry | F02C 3/067 60/268 |
| 8,015,798 | B2 * | 9/2011 | Norris | F02C 3/067 60/268 |
| 8,191,352 | B2 * | 6/2012 | Schilling | F02K 3/072 416/126 |
| 8,375,695 | B2 * | 2/2013 | Schilling | F01D 15/10 60/39.162 |
| 10,260,367 | B2 * | 4/2019 | Haskin | F01D 5/02 |
| 11,428,610 | B2 * | 8/2022 | Pfauch | G01F 23/64 |
| 2013/0223984 | A1 * | 8/2013 | Gehlot | F04D 19/024 29/889.21 |

* cited by examiner

VANELESS CONTRA-ROTATING COMPRESSOR WITH MULTIPLE CONTRA-ROTATING INTERFACES

CROSS REFERENCE TO RELATED APPLICATION

This patent application claims the benefit and priority of Chinese Patent Application No. 202111536523.4, entitled "VANELESS CONTRA-ROTATING COMPRESSOR WITH MULTIPLE CONTRA-ROTATING INTERFACES AND APPLICATION OF VANELESS CONTRA-ROTATING COMPRESSOR" filed on Dec. 15, 2021, the disclosure of which is incorporated by reference herein in its entirety as part of the present disclosure.

TECHNICAL FIELD

The present disclosure belongs to the technical field of gas turbine manufacturing, in particular to a vaneless contra-rotating compressor with multiple contra-rotating interfaces and application of the vaneless contra-rotating compressor.

BACKGROUND

The scholars in the world pay attention to and research the contra-rotating technology which is a technology with large potential values and application values in the field of gas turbines. The contra-rotating technology applied to the aero engines may effectively improve the gyroscopic moment characteristic of the engine and reduce the lengths and the weights of the rotating components, which has obvious effects. The contra-rotating technology applied to the rotating components (such as fan/compressor components and turbine components) of the engine may effectively improve the loading and the matching characteristic of the rotor blades by means of the negative pre-swirl provided by the vaneless contra-rotating technology. At present, the vaneless contra-rotating technology has been widely applied in the turbine components of the aero gas turbine engines. The application of the vaneless contra-rotating technology on the fan/compressor components is widely researched by the scholars in the world, whereas few practical engineering applications and corresponding products exist. By means of the negative pre-swirl brought from the vaneless contra-rotating technology, the rear-row rotors may obtain larger relative inlet velocity under the relatively low circumferential velocity. It not only reduces the stage number of the fan/compressor, but also increases the loading of compressor stage, which is of important significance on the reduction of the weight of the gas turbine engine, especially for the aero gas turbine engine.

However, the extensive use of the application of the existing vaneless contra-rotating technology in the fan/compressor is restricted due to many technical barriers. Specific technical barriers are as follows.

Firstly, the aerodynamic gain brought from the vaneless contra-rotating compressor with a single contra-rotating interface is extremely limited, whereas the structural implementation is relatively complex. At present, the vaneless contra-rotating structure is mainly realized through the double-shaft contra-rotating structure of the rotation shafts of the engine, and may only realize the arrangement of the single contra-rotating interface. Structurally, after the guide vanes among the rotors are not provided, great technical difficulty is brought for the support structure, load-bearing route, internal pipeline arrangement, sealing and rotor dynamic characteristics of the engine and the compressor components, and even more seriously final results may be caused. So, the practical application of the technology is seriously restricted. At present, the vaneless contra-rotating technology with the single contra-rotating interface has been applied in the turbine component of the aero turbine engine. For example, U.S. commissioned F119 military turbofan engine adopts an 1+1 contra-rotating turbine solution, U.S. F135 engine adopts a contra-rotating layout solution with the one-stage high-pressure turbine and the two-stage low-pressure turbine, U.S. GE GEnx civil large-bypass-ratio turbofan engine adopts a contra-rotating solution of the two-stage high-pressure turbine and the seven-stage low-pressure turbine, and both of the tri-rotor civil engine Trent 1000 and Trent XWB turbine components developed by Rolls-Royce company of the United Kingdom adopt a contra-rotating solution of the medium-pressure turbine with the high-and-low pressure turbines. However, relatively fewer contra-rotating fans/compressors are applied, and hardly application of the vaneless contra-rotating technology on the actual modes is achieved. So far, the three-stage fan and the six-stage high-pressure compressor of the U.S. F119 military turbofan engine adopt the double-shaft contra-rotating structures, whereas the outlet stator vanes are retained at the last stage of the upstream fan on the contra-rotating interface. The compression component is just physically contra-rotated, and the aerodynamic gain brought from vaneless contra-rotation is not utilized. The two-stage lift fan of the U.S. commissioned F35B vertical take-off and landing ship-based plane actually adopts a vaneless contra-rotating fan structure based on the single contra-rotating interface. The two-stage vaneless contra-rotating ram compressor technical research developed by the Institute of Engineering Thermophysics, Chinese Academy of Sciences and the two-stage vaneless subsonic contra-rotating compressor technology developed by NWPU (Northwestern Polytechnical University) are still in the experimental research stage, and are not really applied. In the research work of the contra-rotating engine developed by AECC, the compressor finally adopts a contra-rotating structural solution with the inter-stage guide vanes, does not effectively utilize the aerodynamic gain brought from contra-rotation, and has only the single contra-rotating interface.

Secondly, the internal flow mechanism of the vaneless contra-rotating compressor with multiple contra-rotating interfaces is still unclear. At present, the contra-rotating compressor research is mainly focus on the vaneless contra-rotating compressor with a single contra-rotating interface. For example, the research on the two-stage vaneless contra-rotating aspirated compressor with the total pressure ratio of 3.0 is developed in about 2000 in U.S. MIT, the research on the two-stage vaneless contra-rotating supersonic compressor is developed by Institution of Engineering thermophysics, Chinese Academy of Sciences, and the research on the two-stage subsonic vaneless contra-rotating compressor is developed by NWPU.

If two or more than two contra-rotating interfaces are provided, the inter-stage loading distribution rules inside the fan/compressor, the methods of flow organization in stages, the inter-stage flow matching mechanism, the off-design characteristics and the regulation and control method are unclear. So, it is necessary to carry out deep researches of flow mechanism and design method. And, the structural implementation method of the vaneless contra-rotating compressor with multiple contra-rotating interfaces is also relatively difficult. Therefore, combined the above factors, the vaneless contra-rotating fan/compressor technology with multiple contra-rotating interfaces does not appear in the world at present.

Through the analysis mentioned above, the following problems and defects exist in the prior art. At present, the contra-rotating compressor technology which is being researched and has been applied in the world only aims at the contra-rotating compressor technology solution with a single contra-rotating interface, and even retains the stator blades near the contra-rotating interface, which may not effectively obtain the aerodynamic gain brought from the contra rotating. The currently developed vaneless contra-rotating compressor research is also limited to the layout of the single contra-rotating interface. So, the aerodynamic gain brought from the contra-rotating technology is extremely limited and may cause more problems and challenges of structural design, and hence the development and wide application of the vaneless contra-rotating compressor technology are finally seriously restricted as well.

The significance of solving the above-mentioned problems and defects is that, according to the vaneless contra-rotating compressor with multiple contra-rotating interfaces provided by the present disclosure, from an innovative angle of the pressurization mechanism and aerodynamic/structural layout, great pressurization potential on the contra-rotating compressor technology is fully excavated. Under the condition of a single driving shaft, in combination with the planetary gear change or rotating casing with overhang rotor blades, two or more than two vaneless contra-rotating interfaces are created, so that the rear rotor corresponding to each contra-rotating interface may sufficiently utilize inlet negative pre-swirl brought from the upstream rotor on the contra-rotating interface, the relative velocity is effectively promoted, and great pressurization potential is stored for the rear rotor blades. While high pressurization ability of the vaneless contra-rotating compressor with multiple contra-rotating interfaces is achieved, the structural layout is more compact as well. The straightening stator vanes among the rotors are completely not provided, and the row number of blades of the compressor may be reduced by about 50% compared with a conventional solution, so that the axial length, the weight and the stage number of the compressor are greatly reduced. If the increase of the averaged stage loadings of the compressor brought from contra-rotation is taken into account at the same time, the pressurization potential of the multi-stage compressor in the novel structural layout is much higher, and the generated gains of the stage number reduction, length reduction and weight reduction of the compression system are also larger.

SUMMARY

In order to overcome the problems existing in the related technologies, the embodiment disclosed in the present disclosure provides a vaneless contra-rotating compressor with multiple contra-rotating interfaces. The technical solutions are as follows.

A vaneless contra-rotating compressor with multiple contra-rotating interfaces includes at least two vaneless contra-rotating interfaces, and vaneless contra-rotating rotors. For each of the at least two contra-rotating interfaces, the contra-rotating interface corresponds to two of vaneless contra-rotating rotors. A rotating direction of an upstream rotor of the two vaneless contra-rotating rotors and a rotating direction of a downstream rotor of the two vaneless contra-rotating rotors are opposite. A stator vane is not provided between the upstream rotor and the downstream rotor to supply sufficient inlet negative pre-swirl for the downstream rotor through the upstream rotor, such that a relative inlet velocity and pressurization potential of the downstream rotor is improved. Only outlet guide vanes of one, at a last stage, of the vaneless contra-rotating rotors are provided to rectify final outlet airflow in an axial direction of the outlet guide vanes.

In one embodiment, the stator vane may be not provided between the upstream rotor and the downstream rotor to directly supply negative pre-swirl for the downstream rotor produced by the upstream rotor, such that the relative inlet velocity and inlet pressurization potential of the downstream rotor may be well improved.

In one embodiment, a rotor blade disc of one, at each stage, of the vaneless contra-rotating rotors may be driven by a single transmission shaft or double transmission shafts, and one of the double transmission shafts may drive the rotors rotating in clockwise direction and the other one of the double transmission shafts may drive the rotors rotating in anti-clockwise direction, and the double transmission shafts may have opposite rotating direction to each other.

In one embodiment, a contra-rotating direction and a rotating speed value of the rotor blade disc may be adjusted by planetary transmission gears with different sizes and transmission ratios.

In one embodiment, a contra-rotating rotation of one rotor, at each stage, of the vaneless contra-rotating rotors and a contra-rotating rotation of one, adjacent to the one rotor may have opposite directions through the planetary transmission gears, and a rotating speed of the upstream rotor and a rotating speed of the downstream rotor may be set to be same or different by the planetary transmission gears.

In one embodiment, rotating speeds of ones of the vaneless contra-rotating rotors which may be in a same rotating direction may be set to be same or different by adjusting a transmission ratio of the planetary transmission gears corresponding to one rotor, at each stage, of the vaneless contra-rotating rotors.

In one embodiment, a rotation of the single transmission shaft or a rotation of the double transmission shafts may be transmitted to a rotating shaft of one, at a corresponding stage, of the vaneless contra-rotating rotors through a main transmission shaft, so as to drive the rotor blade disc to rotate to compress gas. The rotating direction and the rotating speed value of the rotor blade disc may be adjusted by the planetary transmission gears corresponding to one rotor, at each stage, of the vaneless contra-rotating rotors.

A transmission ratio of the planetary transmission gears corresponding to the one rotor, at each stage, of the vaneless contra-rotating rotors may be set according to actual requirements of the rotating speed of the one rotor, so as to obtain expected rotating speed and stage load of the one rotor.

In one embodiment, a fixed support may be a total supporting platform for the rotor blade disc of one, at each stage, of the vaneless contra-rotating rotors, and the rotor blade disc is supported by two load-carrying bearings.

In one embodiment, due to some geometric and structure restrictions, the stator vanes at the outlets of the upstream rotors are allowed to be retained near some parts of the contra-rotating interfaces. At this moment, the downstream rotors near the contra-rotating interfaces with stator vanes may not use inlet negative pre-swirl, and only contra-rotating structures on the physical layout is achieved.

In combination with all the above-mentioned technical solutions, the embodiments have the following advantages and positive effects.

Firstly, the embodiments aim to provide a vaneless contra-rotating compressor with multiple contra-rotating interfaces in novel aerodynamic layout, which is an innovative structure proposed under a traditional aerodynamic layout of a multi-stage compressor which utilizes the foundation form of rotor-and-stator. Compared with the existing contra-rotating compressor, the vaneless contra-rotating compressor is provided with two or more than two contra-rotating interfaces (the number of stages and the number of contra-rotating interfaces may be flexibly set according to the actual pressurization ability requirements). Straightening stator vanes among all the rotors are not provided, and only the straightening stator vane at the outlet of the last-stage rotor is retained. The negative pre-swirl gain from contra-rotation may be furthest utilized, and the row number of the multi-stage compressors is greatly reduced, so that the technical bottleneck of a traditional vaneless contra-rotating compressor due to limited aerodynamic gain and unusually complex structural problems caused by a single contra-rotating interface is overcome. The potential of contra-rotating technology is fully developed and applied to the actual models and products of turbomachinery according to the vaneless contra-rotating compressor of the present disclosure.

Secondly, the vaneless contra-rotating compressor with multiple contra-rotating interfaces adopts a single transmission shaft inputting the shaft work into the multi-stage rotors, and also may adopt double contra-rotating transmission shafts inputting shaft work into the multi-stage upstream and downstream rotors respectively. In the process of the shaft work (i.e., rotation) transmission, the transmission of the shaft works among the different rotors is achieved by means of the planetary transmission gears with different sizes and transmission ratios, and the adjustment of the rotating speed and rotating directions of the rotors may be achieved by adjusting the transmission ratios. Therefore, in the aerodynamic/structural solution of the novel contra-rotating compressor, opposite rotating directions of the adjacent rotors may be achieved by adopting the contra-rotating structure, so that the upstream rotors near the contra-rotating interfaces provide sufficient inlet negative pre-swirl for the downstream rotors. The rotating speed of each row of contra-rotating rotors may be further flexibly set by adjusting the transmission ratios of the planetary transmission gears, namely all the clockwise rotating rotors and all the anti-clockwise rotating rotors (along the direction from the inlet to the outlet) may be of the same rotating speeds respectively, and may also be of a certain difference between the rotating speeds.

Thirdly, in the term of the aerodynamic layout aspect of the vaneless contra-rotating compressor with multiple contra-rotating interfaces, since the straightening stator vanes among all the contra-rotating rotors are not provided, the upstream rotor blade row and the downstream rotor blade row on each contra-rotating interface are contra-rotating rotors in opposite rotating directions, and the rotors follow strict load matching, flow matching, absolute flow angle matching, so the relative airflow conditions at the inlet of each rotor may be subsonic, transonic or supersonic. The maximum average stage-pressure ratio of the multi-stage vaneless contra-rotating compressor in novel aerodynamic/structural layout may be reached between 1.5 and 2.0, or even higher, and higher pressurization potential is achieved.

Fourthly, in the term of the stage circulation distribution of the vaneless contra-rotating compressor with multiple contra-rotating interfaces, in order to furthest utilize the inlet negative pre-swirl, the spanwise distribution of outlet circulation of the upstream rotors on each contra-rotating interface may be approximately linear with larger one near blade root and smaller one near blade tip, so as to realize a larger inlet relative velocity of the downstream rotor on each of the contra-rotating interfaces.

Fifthly, the outlet stator vanes in the last stage of the vaneless contra-rotating compressor with multiple contra-rotating interfaces may be an integrated structure combined with the inner hub and outer casing. Specifically, an integral stator vane disc structure or a combined machining and welding manner may be adopted.

Sixthly, under the geometrically and totally structural restrictions of the vaneless contra-rotating compressor with multiple contra-rotating interfaces, the outlet stator vanes are allowed on the upstream rotors of parts of the contra-rotating interfaces, and the corresponding downstream rotors may not take advantage of the negative pre-swirls provided by the upstream rotors of the contra-rotating interfaces, and only the contra-rotating structures in the physical layout are achieved.

Seventhly, the vaneless contra-rotating compressor with multiple contra-rotating interfaces is applicable for an axial-flow type compressor, an oblique-flow type compressor, a centrifugal compressor and various combined compressors based on the above-mentioned compressors. The compressor may be applied in the fields of aero gas turbine engines, ground/marine gas turbines, and also may be applied to the fields of chemical machinery, mining machinery, ventilating machinery and other equipment.

It should be understood that the foregoing general description and the following detailed description are merely illustrative and explanative, and are not intended to limit the present disclosure.

BRIEF DESCRIPTION OF THE DRAWINGS

The drawings herein are incorporated in Description as a part of Description, showing embodiments that are in accordance with the present disclosure, and used together with Description to explain a principle of the present disclosure.

LIST OF THE REFERENCE CHARACTERS

1 load-carrying bearing; 2 planetary transmission gear; 3 fixed support; 4 main driving shaft; 5 clockwise rotating rotor $R_1$; 6 anti-clockwise rotating rotor $R_2$; 7 clockwise rotating rotor $R_3$; 8 anti-clockwise rotating rotor $R_4$; 9 clockwise rotating rotor $R_5$; 10 anti-clockwise rotating rotor $R_6$; and 11 clockwise rotating rotor $R_7$; and 12 rotor blade disc.

DETAILED DESCRIPTION OF THE EMBODIMENTS

To make the foregoing objective, features and advantages of the present disclosure clearer and more comprehensible, the specific embodiment of the present disclosure is further described in detail below with reference to the drawings. Many specific details are elaborated in the following description, so that the present disclosure is sufficiently understood. However, the present disclosure may be implemented in many other ways different from those described herein, and those skilled in the art may make similar improvements without violating the meaning of the present disclosure, so that the present disclosure is not subject to specific implementations disclosed below.

According to a vaneless contra-rotating compressor with multiple contra-rotating interfaces, the stage load of the compression system has greatly increased, the length, the weight and the stage number of the compressor are significantly reduced, and key technical support is provided for aero gas turbine engines with high thrust-weight ratio. Moreover, the vaneless contra-rotating compressor with multiple contra-rotating interfaces may be further applied to ground/marine gas turbines, industrial compressors and gas compression devices in the fields of chemical machinery, mining machinery and indoor ventilating machinery, and has great technological potential.

Figure 1:
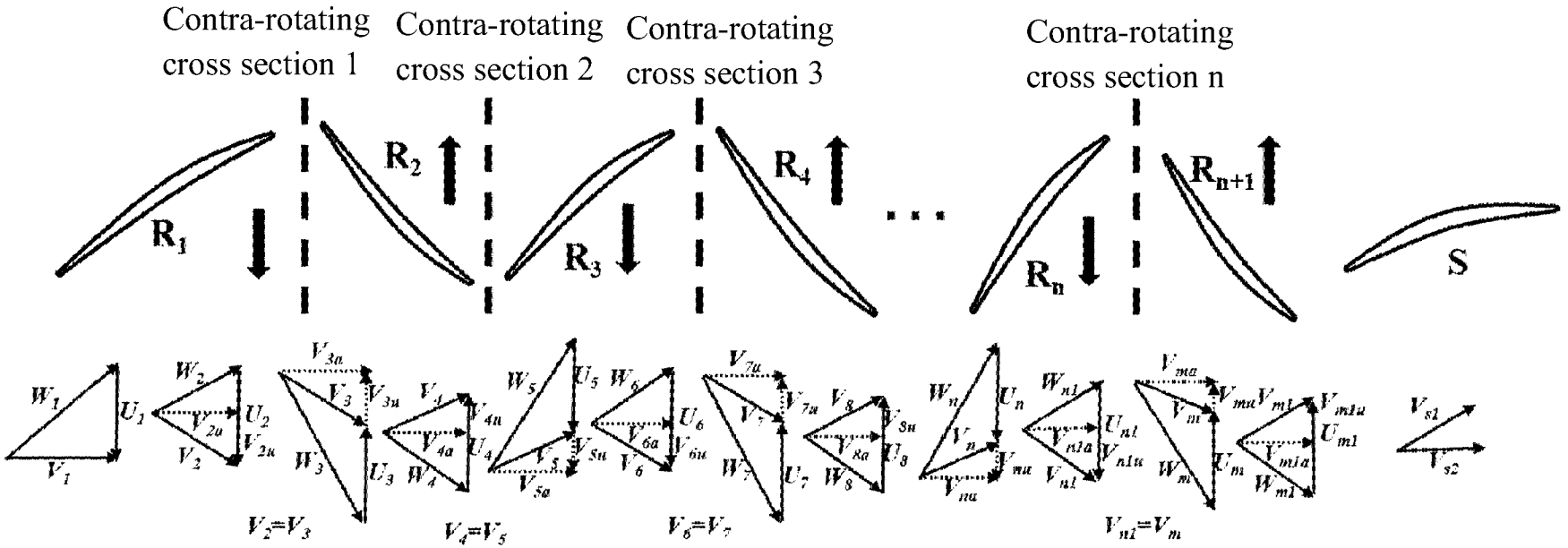
FIG. 1 is a schematic diagram of the aerodynamic layout distribution and velocity triangles corresponding interfaces of a vaneless contra-rotating compressor with multiple contra-rotating interfaces provided by the embodiment of the present disclosure.

The working principle of the vaneless contra-rotating compressor with multiple contra-rotating interfaces is shown in FIG. 1. The vaneless contra-rotating compressor includes at least two contra-rotating interfaces, and for each of the at least two contra-rotating interfaces, the two rotors on each contra-rotating interface of vaneless contra-rotating compressor have opposite rotating directions, so that the upstream rotor row may provide sufficient inlet negative pre-swirl for the downstream rotor row, and then the inlet relative velocity and pressurization potential of the downstream rotor row are improved. straightening stator vanes are not provided among all the rotors, only the outlet guide vanes of the last stage of the vaneless contra-rotating compressor are provided to rectify the final outlet airflow into an axial direction in channels.

After the inter-stage stator vanes on each contra-rotating interface are not provided, the downstream rotors of the contra-rotating interfaces are strictly follows the restrictions of the inlet velocity triangle, the requirements are put forward for the value of the negative pre-swirl at the outlet of the upstream rotor, and the outlet airflow condition of the upstream rotor must reach the expected value of pre-swirl value in stage design of vaneless contra-rotating compressor. Besides the restrictions of inter-stage negative pre-swirl need to be met, the three requirements of the flow matching, rotating speed matching and outlet pressure matching of the rotor blades also need to be strictly followed among different rotor stages, so that the overall performances of the vaneless contra-rotating compressor with multiple contra-rotating interfaces finally meet the design requirements.

In the aspect of aerodynamic layout, firstly, the stator vanes among all the rotors are not provided, and the axial length, the weight and the blade row number of the multi-stage compressor are greatly reduced, so that the whole compressor structure is more compact. Secondly, the upstream rotor on each contra-rotating interface may provide sufficient negative pre-swirl for the corresponding downstream rotor on the contra-rotating interface. Under the condition of following strict load matching, flow matching, rotating speed matching and pressure matching, the inlet relative velocity and the inlet pressurization potential of the downstream rotor may be greatly promoted. Higher stage-pressure ratio is achieved by adopting fewer blades and row numbers, and finally the averaged stage load of the multi-stage compressor is obviously increased, so that multiple purposes of blade row reduction, length reduction and weight reduction of the compressor are further achieved accompanied with high load level. Through the vaneless contra-rotating interfaces, under the same load level, the inter-stage stator vanes of all rotors of the multi-stage compressor may not be provided. Theoretically, approximate 50% of the length and the weight of the compression system may be reduced compared with that in the traditional solution, and maximized aerodynamic gain of contra-rotating effect is achieved, which is of great significance on stage reduction and weight reduction of the advanced aero engine compression system.

In the aspect of structural layout, firstly, the vaneless contra-rotating compressor with multiple contra-rotating interfaces drives the rotor blade discs 12 of all stages of the compressor by adopting a single transmission shaft or double transmission shafts, and the two shafts of the double transmission shafts structure have opposite rotating direction and are arranged on both ends of the compression system. Specifically, the contra-rotating directions and the rotating speed values of different rotor blade discs 12 may be adjusted through the planetary transmission gears 2 with different sizes and transmission ratios, so as to ensure the overall aerodynamic performances of each stage of rotors with high-pressurization capacity. Secondly, besides the contra-rotating rotation of all the rotors in the vaneless contra-rotating compressor with multiple contra-rotating interfaces by means of the planetary transmission gears 2, the rotating speed values of all the clockwise rotating rotors (from the upper stream to the down stream) and the rotating speed values of all the anticlockwise rotating rotors (from the upper stream to the down stream) may be set to be same or different by means of the planetary transmission gears 2. Specifically, the rotating speed value of each row of rotors may be flexibly set according to the requirement of aerodynamic matching performance among all the rotors. By means of a planetary gear solution or an overhanging rotor with rotating casing solution, the applicability of the vaneless contra-rotating interfaces is ensured, and the structural complexity is not obviously increased, even the multi-stage structural with multiple vaneless contra-rotating interfaces may be achieved through a single driving shaft.

In FIG. 1, for main gain of contra-rotation, in one aspect, the circumferential component velocity $V_{iu}$ of the absolute velocity on the outlet of the upstream rotor of each contra-rotating interface may be directly as a negative pre-swirl of increasing the inlet relative velocity of the downstream rotor, and the relative inlet velocity and pressurization potential of the downstream rotor are greatly promoted under the given circumferential velocity U. In the other aspect, the straightening stator vanes among all the rotors are not provided, and therefore, the blade row number, the axial length and the weight of the multi-stage compressor are greatly reduced, and important technical support is provided for weight reduction of the compression component of the aero gas turbine engine. Moreover, besides the difference of the rotating directions, difference setting of the rotating speed values of the rotors at all the stages in the vaneless contra-rotating compressor in novel layout may be achieved, and good matching characteristics among multiple stages of rotors are conveniently and preferably achieved.

Figure 2:
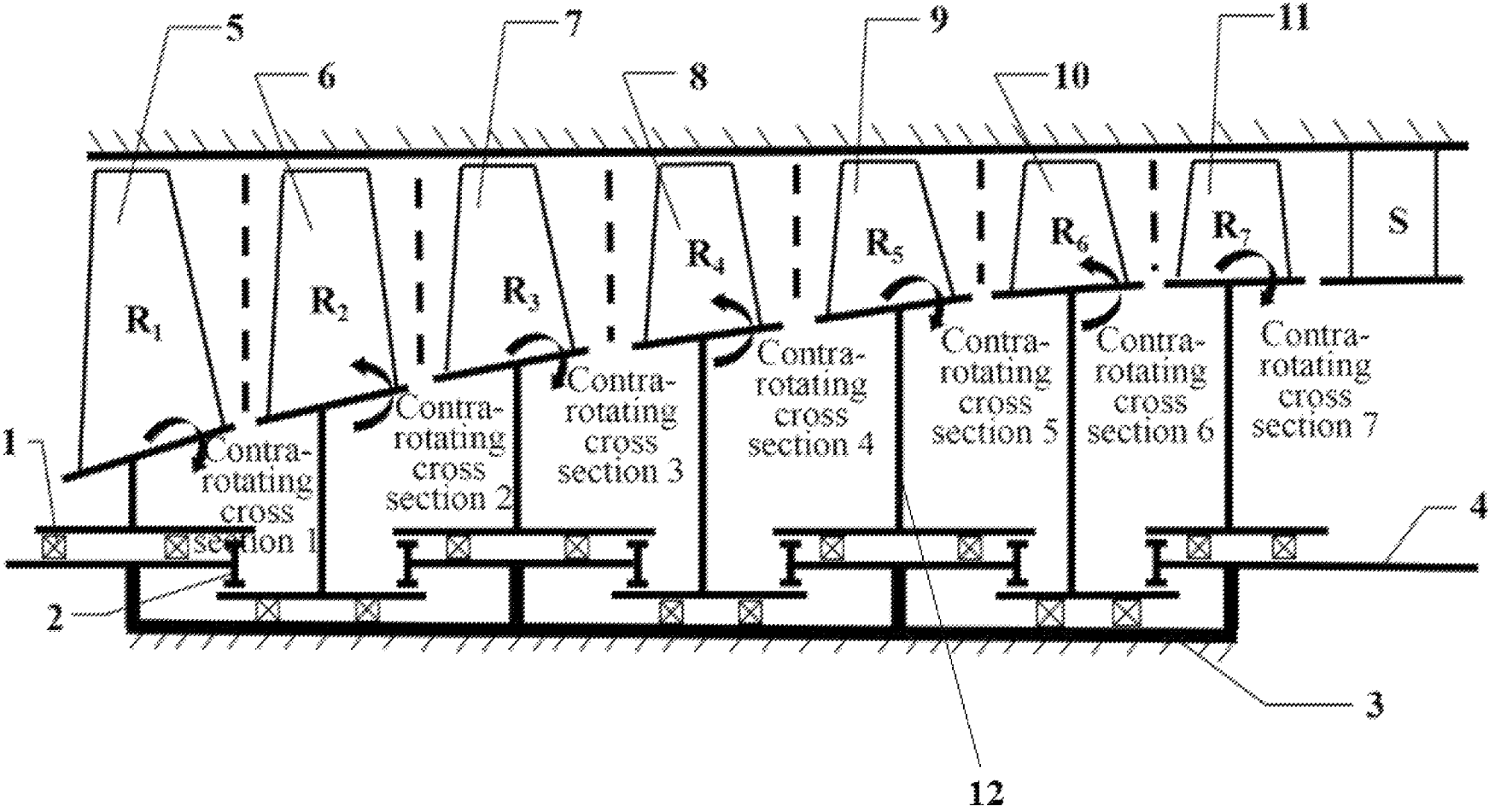
FIG. 2 is a structural schematic diagram of the vaneless contra-rotating compressor with multiple contra-rotating interfaces provided by the embodiment of the present disclosure.

The structure of the vaneless contra-rotating compressor with multiple contra-rotating interfaces is shown in FIG. 2. In FIG. 2, the structure of a seven-stage vaneless contra-rotating compressor is taken as an example to describe the implementation of the novel structural layout of compressor in details. The seven-stage vaneless contra-rotating compressor includes six vaneless contra-rotating interfaces, and the outlet straightening stator vanes of the seventh stage are retained. Compared with the conventional multi-stage axial flow compressor, six rows of inter-stage stator vanes may be reduced under the given load levels. If the aerodynamic gain brought from contra-rotation is taken into account, the pressurization potential of the compressor in novel layout is relatively larger, the averaged stage-pressure ratio may reach 1.5 to 2.0 approximately at most, or even higher, and the compressor has extremely obvious pressurization potential and more compact structure. The rotating directions of rotor $R_1$ 5, the rotating direction of rotor $R_3$ 7, the rotating direction of rotor $R_5$ 9 and the rotating direction of rotor $R_7$ 11 of the seven-stage vaneless contra-rotating compressor are the same, and they all rotate in the clockwise direction (from the upper-stream to the downstream along the rotating shaft). The rotating direction of the rotor $R_2$ 6, the rotating direction of rotor $R_4$ 8 and the rotating direction of rotor $R_6$ 10 are the same, and they all rotate in the anticlockwise direction (from the upper-stream to the downstream along the rotating shaft).

Moreover, the rotating speeds of all the rotors in the same rotating direction may be set to be the same or different by adjusting the transmission ratio of the planetary transmission gear 2 corresponding to the position of the rotor at each stage. All shaft works may be transferred to the rotating shaft of the rotor at each stage from the main transmission shaft 4 on the right side, to drive the rotor blade disc 12 to rotate to compress air. The rotating direction and the rotating speed value of the rotor are adjusted by the planetary transmission gear 2 corresponding to the rotor at each stage. A fixed support 3 is a total supporting platform for all the rotor blade discs 12, and each rotor disc is fixed by two load-carrying bearings 1. The transmission ratio of one planetary transmission gear 2 or two planetary transmission gears 2 corresponding to the rotor at each stage may be customized and designed according to the actual requirements of the corresponding rotating speed, so as to achieve expected rotating speed and stage load of the rotor. Moreover, the straightening stator vane at the outlet of the last-stage rotor is of an integral structure integrated with the casing and hub, and a supporting structure does not need to be added. For the seven-stage vaneless contra-rotating compressor structure in FIG. 2, if the stage number and the contra-rotating interfaces need to be increased or decreased, the corresponding supporting structure may be adjusted flexibly. The novel vaneless contra-rotating compressor with multiple contra-rotating interfaces provided in the present disclosure is applicable for the layout of a vaneless axial-flow type contra-rotating compressor with two or more than two contra-rotating interfaces, and is also applicable for the layout of an oblique-flow type, centrifugal or combined vaneless multi-stage contra-rotating compressor with two or more than two contra-rotating interfaces.

Compared with the traditional compressor in conventional layout, the vaneless contra-rotating compressor with multiple contra-rotating interfaces adopts the vaneless contra-rotating technology, the straightening stator vanes among the rotors are not provided, and the downstream contra-rotating rotor blades use the inlet negative pre-swirl provided by the upstream rotors, so that the inlet relative velocity may be obviously increased with the same circumferential velocity of the conventional compressor, and higher pressurization potential is stored for high total pressure ratio of the rotors. Therefore, compare with a conventional rotor-and-stator layout compressor with all rotors rotating in the same direction, the novel vaneless contra-rotating compressor has greater technical advantages and higher pressurization capacity and compactness of aerodynamic and structural layout. Compared with the existing vaneless or physical contra-rotating compressor with a single contra-rotating interface, the novel vaneless contra-rotating compressor with multiple contra-rotating interfaces overcomes the prominent problems of seriously limited aerodynamic gain and great structural complexity caused by the single contra-rotating interface, and also may sufficiently perform the great gains of contra-rotating effect in the aspects of high pressurization, high stall margin, compact structure and the like. The straightening stator vanes among all the rotors are not provided, and therefore, obvious technical support is provided for the blade row number reduction, the axial length reduction and the weight reduction of the compressor. Moreover, the novel vaneless contra-rotating compressor adopts the planetary transmission gears 2 to input shaft works for each row of rotor blade discs 12, so that the compressor is applicable for the compression system with a single transmission shaft, and is also applicable for the high loading compression system with double transmission shafts, and the rotating speed values of each stage of rotor blades may be flexibly set by adjusting the transmission ratio of the planetary transmission gears 2 according to the pressurization requirement of each stage of rotor of the compression system, resulting in an important technical way of greatly promoting the high-load compression system.

Embodiment

In order to verify the vaneless contra-rotating compressor with multiple contra-rotating interfaces provided by the present disclosure, a four-stage vaneless contra-rotating compressor (with three vaneless contra-rotating interfaces) is taken as an example, and the aerodynamic design of the novel aerodynamic layout compressor is completed.

The contra-rotating compressor is provided with five rows of four-stage axial-flow blades. The contra-rotating compressor includes four rotor rows and one outlet stator vane row. The inter-stage stator vanes among the rotors at all stages are not provided, and the rotating directions of every two adjacent rotors are opposite. The outlet straightening stator vanes at the outlet of the compressor are retained. Compared with the conventional four-stage axial-flow type compressor with four rotor rows and four guide vane rows, three rows of vanes of the contra-rotating compressor are reduced, and the axial length of the contra-rotating compressor is obviously reduced. Under the condition that the circumferential velocity of the four-stage vaneless contra-rotating compressor is relatively small, the total pressure ratio with the design point of 6.55 is achieved, and the averaged stage-pressure ratio reaches about 1.6 and is about 10% higher than that of the compression component of the fourth generation turbine engine in the world at present. After the combination with the structural strength check of the rotor blade discs 12 and the optimization of the rotor dynamic characteristics, the working speed of each rotor disc of the compressor may be further promoted. In combination with an Euler formula (1), after the working speed of the compressor is promoted, the average stage-pressure ratio and total pressure ratio of the novel compressor may be further promoted.

$$\Delta h = U(Cu_2 - Cu_1) \quad (1)$$

The main design parameters and flow characteristics and the distribution of a flowfield of the four-stage vaneless contra-rotating compressor are as follows.

The design parameters of the novel multi-stage vaneless contra-rotating compressor are shown in the table I.

Table I, Design Indexes of the Four-Stage Vaneless Contra-Rotating Compressor

TABLE I

| | |
|---|---|
| Design flow (kg/s) | 16.5 |
| Design pressure ratio | 6.55 |
| Isentropic efficiency | 85% |

Figure 3:
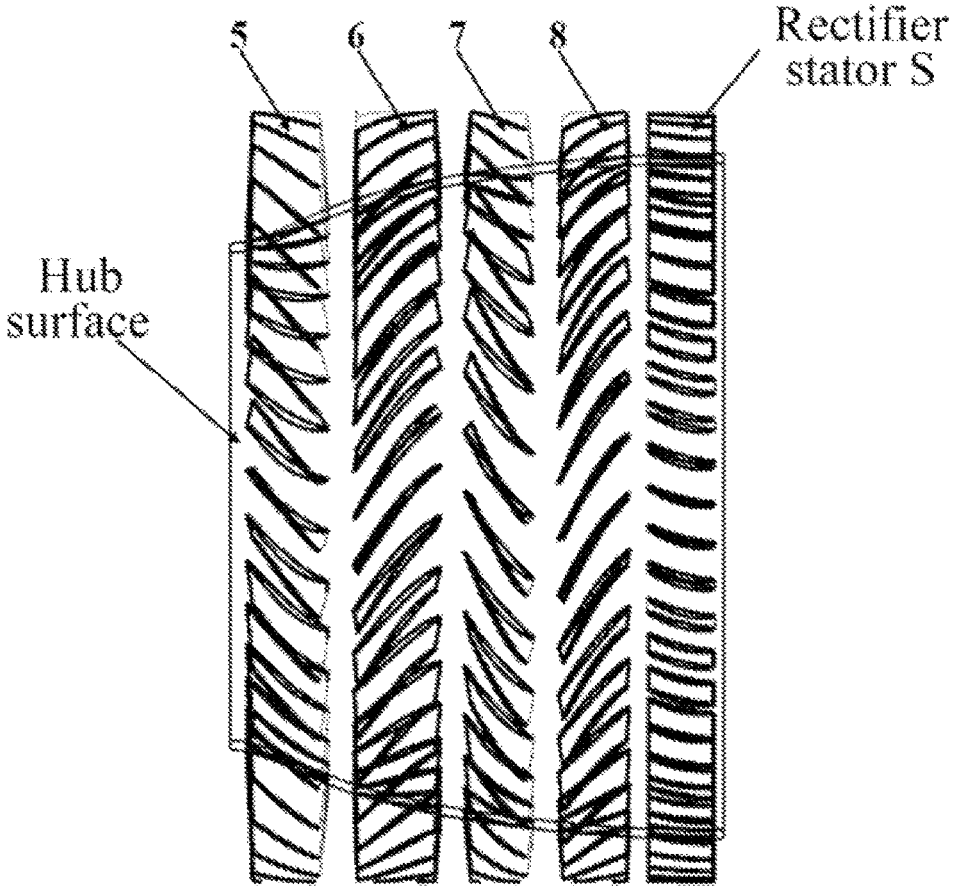
FIG. 3 is a structure diagram of three-dimensional blades of a certain four-stage vaneless contra-rotating compressor provided by the embodiment of the present disclosure.
Figure 4:
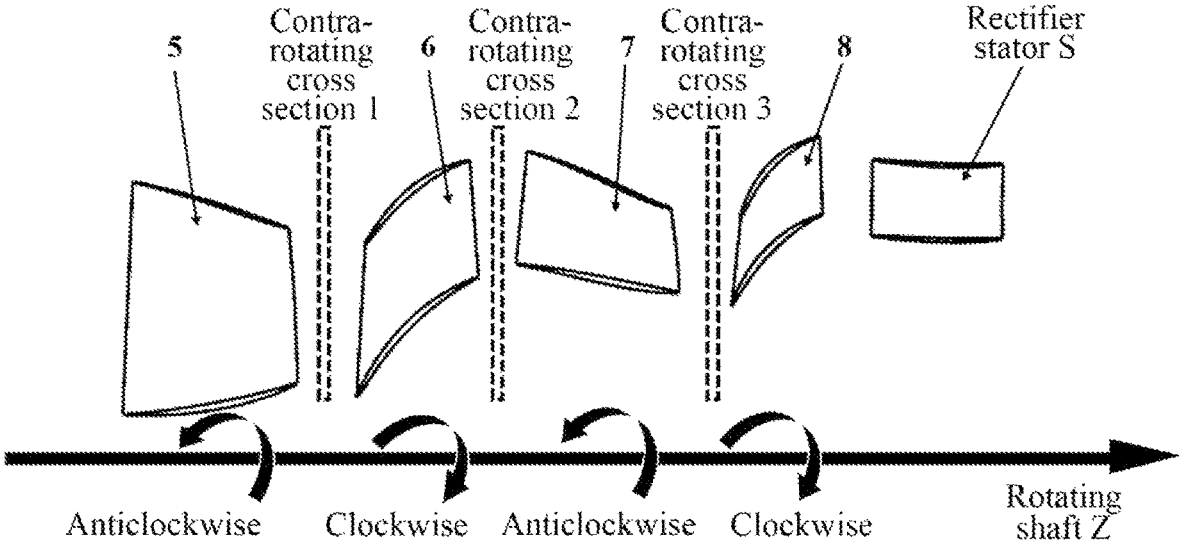
FIG. 4 is a schematic diagram of three-dimensional blades rotating around Z-axis of a certain four-stage vaneless contra-rotating compressor provided by the embodiment of the present disclosure.

The three-dimensional structure of the designed vaneless contra-rotating compressor with three contra-rotating interfaces is shown in FIG. 3 and FIG. 4. The rotating speed value (16000 rpm) and the rotating direction (rotating in the anticlockwise direction from the upper-stream to the downstream) of Rotor 1 and the rotating speed value (16000 rpm) and the rotating direction (rotating in the anticlockwise direction from the upper-stream to the downstream) of Rotor 3 are the same. The rotating speed value (11000 rpm) and the rotating direction (rotating in the clockwise direction from the upper stream to the down stream) of Rotor 2 and the rotating speed value (11000 rpm) and the rotating direction (rotating in the clockwise direction from the upper stream to the down stream) of Rotor 4 are the same. The stator vanes are retained at the outlet of the compressor to convert the velocity direction of absolute airflow into the axial direction.

The main design parameters of the four-stage vaneless contra-rotating compressor are as shown in the table II. The rotor at the first stage is in a transonic inlet condition, the rotor at the second stage and the rotor at the third stage are in a supersonic inlet condition, the rotor at the fourth stage is in a subsonic inlet condition, and the direction of the outlet airflow of the stator vanes is the axial direction.

Table II, Design Parameter Distribution of the Four-Stage Vaneless Contra-Rotating Compressor

TABLE II

| | Rotor1 | Rotor2 | Rotor3 | Rotor4 | OGV | Entire stage |
|---|---|---|---|---|---|---|
| Design flow (kg/s) | | | 16.8 | | | |
| Total pressure ratio | 1.86 | 1.55 | 1.779 | 1.38 | | 6.55 |
| Isentropic efficiency | 0.91 | 0.8 | 0.913 | 0.85 | | 0.85 |
| Maximum outer diameters (mm) | 0.216 | 0.216 | 0.216 | 0.216 | | |
| Rotating speed (rpm) | −16000 | 11000 | −16000 | 11000 | | |
| Inlet hub ratio | 0.66 | 0.77 | 0.66 | 0.67 | | |
| Outlet hub ratio | 0.750 | 0.83 | 0.89 | 0.89 | | |
| Inlet relative Mach number | 0.89-1.25 | 1.27-1.32 | 1.02-1.2 | 0.96-1.01 | 0.27-0.34 | |
| Outlet relative March number | 0.64-0.75 | 0.62-0.66 | 0.45-0.6 | 0.47-0.52 | 0.2-0.3 | |
| Inlet absolute Mach number | 0.51-0.64 | 0.75-0.86 | 0.42-0.52 | 0.53-0.58 | 0.27-0.34 | |
| Outlet absolute March number | 0.75-0.85 | 0.51-0.52 | 0.52-0.55 | 0.3-0.36 | 0.2-0.3 | |
| Camber angles | 47/24 | 39.2/24.8 | 47.5/24.08 | 39.2/24.8 | 39.2/24.8 | |
| blade number | 35 | 39 | 33 | 37 | 57 | |
| Chord lengths at mid-span(mm) | 57.7 | 72.5 | 64.6 | 70.57 | 38.6 | |
| Axial chord lengths (mm) | 44.586 | 48.3 | 37.26 | 38.83 | 37.8 | |
| Aspect ratio | 1.26 | 0.67 | 0.541 | 0.29 | 0.63 | |

Figure 5A:
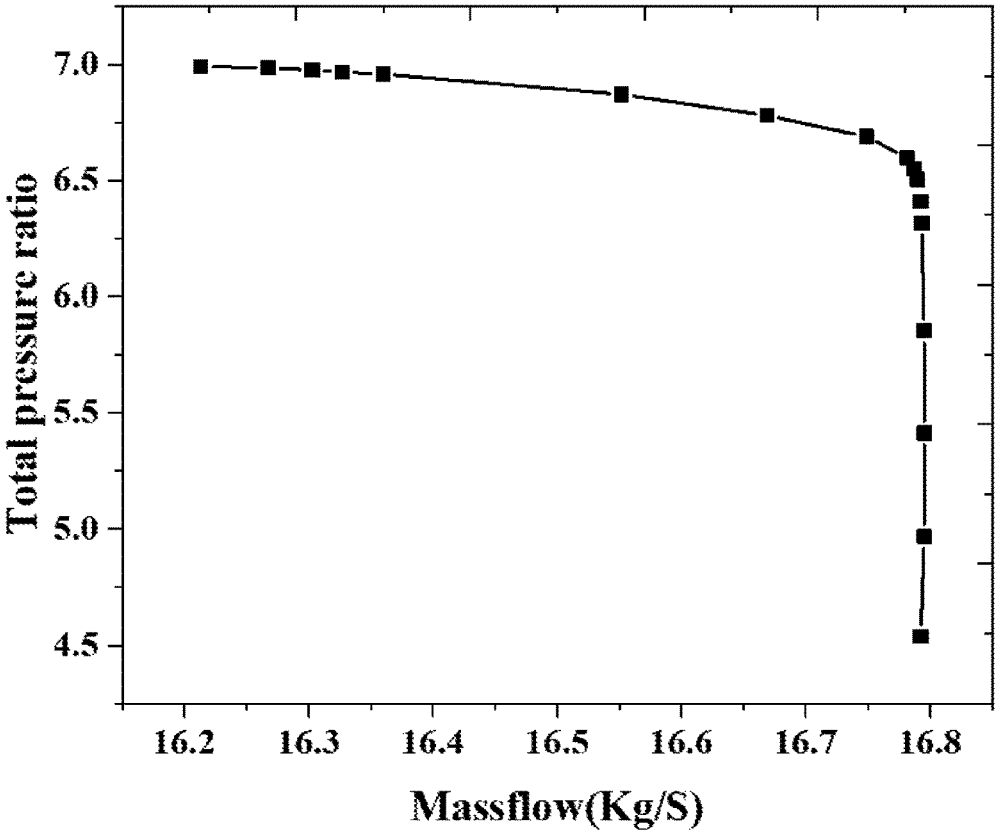
FIG. 5A is a performance curve distribution at design speed of the four-stage vaneless contra-rotating compressor provided by the embodiment of the present disclosure, and shows a variation of a total pressure ratio along with flow rate.
Figure 5B:
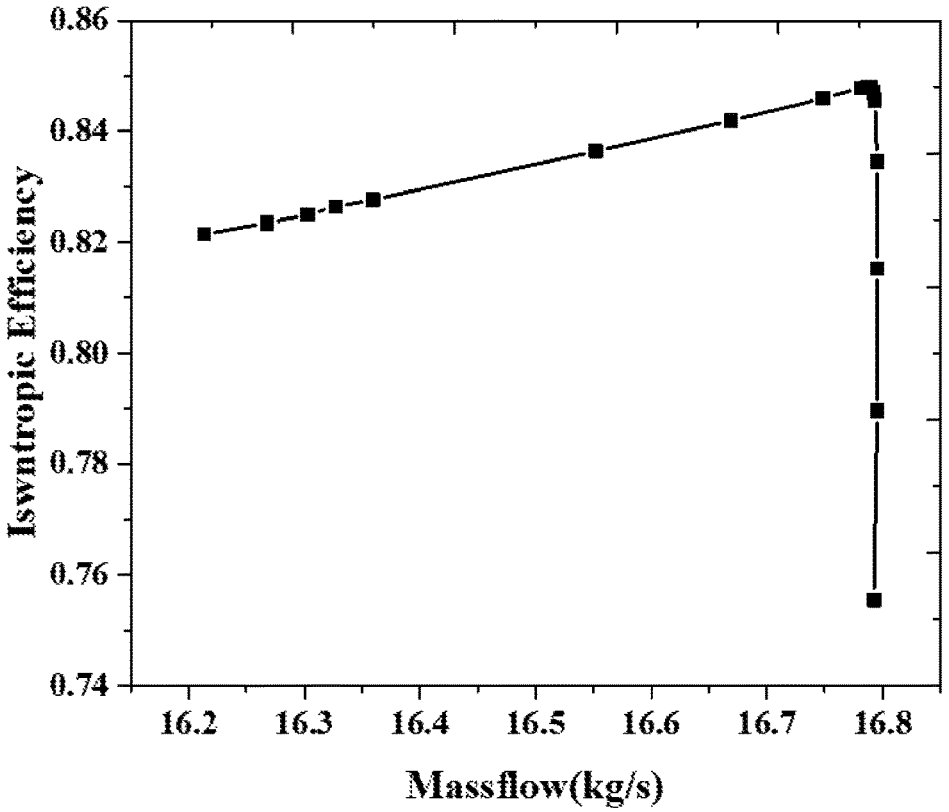
FIG. 5B is another performance curve distribution diagramat design speed of the four-stage vaneless contra-rotating compressor provided by the embodiment of the present disclosure, and shows a variation of isentropic efficiency along with flow rate.

The key parameters of the four-stage compressor at design point and the near-stall point are shown in the table III. The working characteristic lines under the design rotating speed are as shown in FIGS. 5A-5B. The total pressure ratio of the design point of the compressor is 6.55, and the maximum pressure ratio approaches to 7 (about 6.992). The compressor has higher pressurization potential, and has the typical features such as few blade rows and short axial length (the axial length of each blade row is equivalent to that of a conventional axial-flow compressor).

Table III, the Working Characteristics at Design Point and Near-Stall Point of Four-Stage Vaneless Contra-Rotating Compressor at Design Rotating Speed.

TABLE III

| rotating speed100% design speed | | | | |
|---|---|---|---|---|
| | Mass flow (kg/s) | Total pressure ratio | Isentropic efficiency | Total pressure recovery coefficients of outlet stator vane |
| Design points | 16.8 | 6.55 | 0.85 | 0.93 |
| Near-stall points | 16.21 | 6.99 | 0.822 | 0.991 |

The distribution of the internal flow field is relatively reasonable. Each of the contour distribution has a clear shock wave structure, and is free of obvious flow separation phenomenon.

Through the vaneless contra-rotating compressor with multiple contra-rotating interfaces provided by the present disclosure, the great aerodynamic gain brought by the vaneless contra-rotating interfaces may be fully developed. The applicability and operability of the multi-stage contra-rotating structure may be ensured, and is of important significance on the stage reduction and weight reduction of the compression component of the aero gas turbine engine. The technology also may be expanded to the novel high-performance and compact aero gas turbine engine technology of the novel compression system layout structure and the implementation of the technology, and has good application values and market prospects in the future.

This application is intended to cover any variations, functions, or adaptive changes of the present disclosure. These variations, functions, or adaptive changes comply with general principles of the present disclosure, and include common knowledge or a commonly used technical means in the technical field that is not disclosed in the present disclosure. The specification and the embodiments are merely considered as examples, and the actual scope and the spirit of the present disclosure are pointed out by the following claims. It should be understood that the present disclosure is not limited to the accurate structures that are described in the foregoing and that are shown in the drawings, and modifications and changes may be made without departing from the scope of the present disclosure. The scope of the present disclosure is limited only by the appended claims.

What is claimed is:

1. A vaneless contra-rotating compressor with multiple contra-rotating interfaces, comprising:

at least two vaneless contra-rotating interfaces, and vaneless contra-rotating rotors, wherein for each of the at least two contra-rotating interfaces, the contra-rotating interface corresponds to two of vaneless contra-rotating rotors, a rotating direction of an upstream rotor of the two vaneless contra-rotating rotors and a rotating direction of a downstream rotor of the two vaneless contra-rotating rotors are opposite; a stator vane is not provided between the upstream rotor and the downstream rotor to supply sufficient inlet negative pre-swirl for the downstream rotor through the upstream rotor, such that a relative inlet velocity and pressurization potential of the downstream rotor is improved; and only outlet guide vanes of one, at a last stage, of the vaneless contra-rotating rotors are provided to rectify final outlet airflow in an axial direction of the outlet guide vanes;

wherein a rotor blade disc of one, at each stage, of the vaneless contra-rotating rotors is driven by a single transmission shaft or double transmission shafts, and an end of one of the double transmission shafts and an end of an other one of the double transmission shafts are arranged oppositely;

wherein a contra-rotating direction and a rotating speed value of the rotor blade disc are adjusted by planetary transmission gears with different sizes and transmission ratios;

wherein rotating speeds of ones of the vaneless contra-rotating rotors which are in a same rotating direction are set to be different by adjusting a transmission ratio of the planetary transmission gears corresponding to one rotor, at each stage, of the vaneless contra-rotating rotors;

wherein a rotation of the single transmission shaft or a rotation of the double transmission shafts are transmitted to a rotating shaft of one, at a corresponding stage, of the vaneless contra-rotating rotors through a main transmission shaft, so as to drive the rotor blade disc to rotate to compress gas, the rotating direction and the rotating speed value of the rotor blade disc are adjusted by the planetary transmission gears corresponding to one rotor, at each stage, of the vaneless contra-rotating rotors; and a transmission ratio of the planetary transmission gears corresponding to the one rotor, at each stage, of the vaneless contra-rotating rotors is set according to actual requirements of the rotating speed of the one rotor, so as to obtain expected rotating speed and stage load of the one rotor.

2. The vaneless contra-rotating compressor with multiple contra-rotating interfaces according to claim 1, wherein a fixed support is a total supporting platform for the rotor blade disc of one, at each stage, of the vaneless contra-rotating rotors, and the rotor blade disc is supported by two load-carrying bearings.

* * * * *